US006394933B1

(12) United States Patent
Yu

(10) Patent No.: US 6,394,933 B1
(45) Date of Patent: May 28, 2002

(54) STRENGTH-SAVING STRUCTURE FOR FOLDABLE TREADMILL EXERCISER

(75) Inventor: Te Liang Yu, Tai Ping (TW)

(73) Assignee: Alilife Industrial Co., Ltd., Taichung Hsien (TW)

( * ) Notice: Subject to any disclaimer, the term of this patent is extended or adjusted under 35 U.S.C. 154(b) by 0 days.

(21) Appl. No.: 09/610,523

(22) Filed: Jul. 7, 2000

(51) Int. Cl.[7] ..... A63B 22/00
(52) U.S. Cl. ..... 482/54
(58) Field of Search ..... 482/54, 51, 57

(56) References Cited

U.S. PATENT DOCUMENTS 6,042,515 A * 3/2000 Wang ..... 482/54
6,179,753 B1 * 1/2001 Barker et al.
6,234,937 B1 * 5/2001 Yu
6,267,710 B1 * 7/2001 Liu

* cited by examiner

*Primary Examiner*—Stephen R. Crow
(74) *Attorney, Agent, or Firm*—Rosenberg, Klein & Lee

(57) ABSTRACT

A strength-saving structure for a foldable treadmill exerciser including a support stand, a movable frame body and two torque springs. The inner sides of the support bars of the support stand are disposed with oppositely extending circular tubes near the bottoms thereof. An arch board is disposed in each circular tube. The circular tube and the arch board define therebetween an arch rail. An arch projecting board of the frame body is slidably fitted in the arch rail. The two torque springs are respectively fitted around the circular tubes of the support bars. A hook section of each torque spring hooks an engaging pin under the circular tube, while a backing section of the torque spring backs the bottom of the long bar of the frame body. The torque springs are prestressed. Accordingly, before the frame body is downwardly unfolded, the frame body is backed by the prestressed torque springs and a part of the gravity making the frame body fall down is offset. Also, after use, a user can easily upward turn and fold the frame body from rear side thereof so as to save strength.

3 Claims, 6 Drawing Sheets

STRENGTH-SAVING STRUCTURE FOR FOLDABLE TREADMILL EXERCISER

BACKGROUND OF THE INVENTION

The present invention relates to a strength-saving structure for a foldable treadmill exerciser. The strength-saving structure includes two torque springs respectively disposed at the bottoms of two sides of a support stand. The torque strings are prestressed to fold back a movable frame body equipped with a running belt. Accordingly, the frame body may be upwardly folded by the prestressed torque springs and the resistive force of gravity is substantially offset thereby so that a user can upwardly fold the frame body without undue physical strain.

FIG. 6 shows a known treadmill exerciser including an upright support stand 80 and a horizontal movable frame body 90 disposed at the bottom of the support stand 80. Rollers 91 are mounted on the front and rear parts of the frame body 90 for retaining an endless running belt 92 thereon. A running board 93 is disposed within the running belt 92 to provide slidable support.

The rear end of the frame body 90 can be turned upward to save room when not in use. Generally, a pneumatic cylinder 94 is mounted at each side of a base seat 81 of the support stand 80. One end of the pneumatic cylinder 94 is connected to the bottom of one side of the frame body 90, while the other end of the pneumatic cylinder 94 is connected to the base seat 81. When folding the frame body 90 upward, the pneumatic cylinder 94 provides a pushing force to assist a user, permitting him or her to conserve strength.

The pneumatic cylinder 94 is equipped with an inner rubber or plastic 0-ring seal (not shown) to avoid leakage of air. However, rubber or plastic material, when subjected to temperature, humidity, light and abrasion, naturally tends to age and deform. Therefore, the internal air in the cylinder 94 often escapes after a period of use, causing the pneumatic cylinder to diminish in its functional capability. Although the pneumatic cylinder 94 could be entirely replaced in that event, the price of such pneumatic cylinder typically increases with its required length. The total weight of the frame body 90 and the peripheral components is considerable (often over 15 kg~20 kg) such that were the air of the pneumatic cylinder 94 to leak, the resultant fall of the frame body 90 could seriously injure the user. To prevent this, a longer pneumatic cylinder is preferred. Hence, replacing such pneumatic cylinder becomes very expensive. In addition, it is impossible to replace simply the O-ring inside the pneumatic cylinder; and full replacement of a faulty pneumatic cylinder is invariably necessary.

SUMMARY OF THE INVENTION

It is therefore a primary object of the present invention to provide a strength-saving structure for folding a treadmill exerciser in which two prestressed torque springs are respectively fitted around circular tubes of support bars to impart an upward folding force for the movable frame body. Therefore, when the frame body is in its folded stowed position, the prestressed torque springs serve to retain the frame body in that position against the force of gravity, so that the danger of sudden unfolding caused by the gravity is reduced. Also, after use, a user is assisted by the torque springs to easily upward fold the frame body, lifting its rear part without much physical exertion.

It is a further object of the present invention to provide the above strength-saving structure for folding a treadmill exerciser to a stowed configuration in which a circular tube and an arch board of a support bar define an arch rail in which a projecting board of the frame body is slidably fitted. Thus, during folding of the frame body, the generated frictional force is distributed so that the useful life of the folding section is prolonged.

It is still a further object of the present invention to provide the above strength-saving structure for folding a treadmill exerciser in which the torque springs are resistant to damage and are of low cost so that the overall cost for the treadmill exerciser is minimized.

According to the above objects, the strength-saving structure for a foldable treadmill exerciser of the present invention includes a support stand having a rectangular base seat at its bottom, wherein each lateral side of the base seat is formed with an upwardly extending support bar, a top end of which is connected with each side of a rail.

The inner sides of the support bars are each disposed near their bottom ends with a circular tube protruding therefrom. An arch board open to below is disposed within the circular tube, such that the circular tube and the arch board define therebetween an arch rail. An inwardly projecting engaging pin is disposed at the inner side of each support bar under the circular tube.

A movable frame body is disposed between the two support bars of the support stand. The frame body is substantially rectangular in configuration, having two longitudinally extending long bars and two transversely extending short bars. At the outer sides of the long bars are formed two arch projecting boards open to below, each of which extends into an arch rail defined by a circular tube and its arch board. Two rollers are pivotally disposed between inner sides of bars at front and rear portions of the frame body, and a running belt is retained about them. A running board is disposd within the running belt.

Two torque springs are respectively fitted on the circular tubes of the support bars. The two torque springs are situated to be coiled in different directions, one end of each torque spring having a hook section disposed proximate the bottom of the support bar for hooking the engaging pin beneath the circular tube, and the other end of the torque spring having a backing section extending transversely from its coiled portions. The backing section serves to engage the bottom of the long bar of the frame body.

BRIEF DESCRIPTION OF THE DRAWINGS

The present invention can be best understood through the following description and accompanying drawings wherein.

DETAILED DESCRIPTION OF THE PREFERRED EMBODIMENTS

Figure 1:
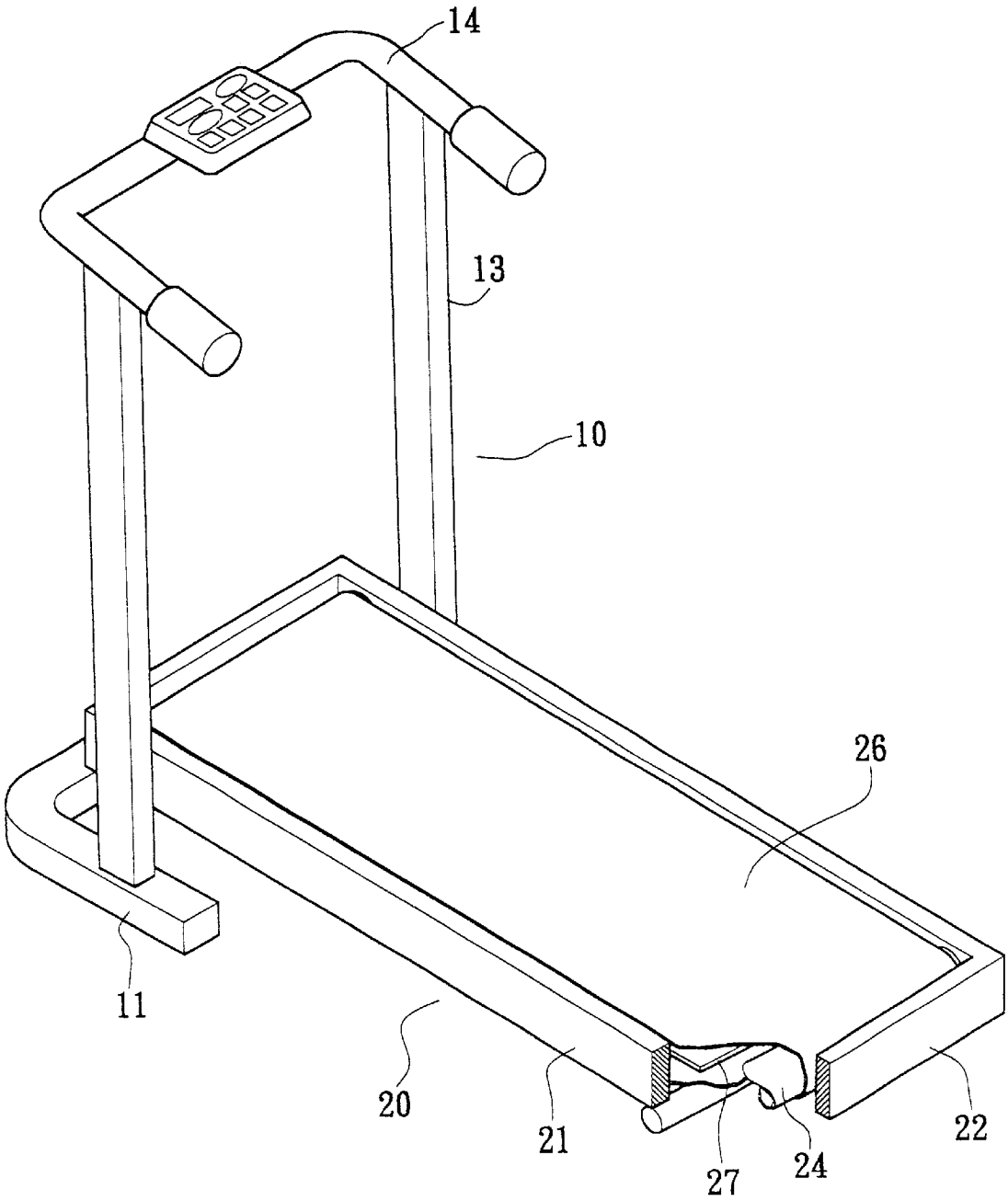
FIG. 1 is a perspective assembled view of the present invention.
Figure 2:
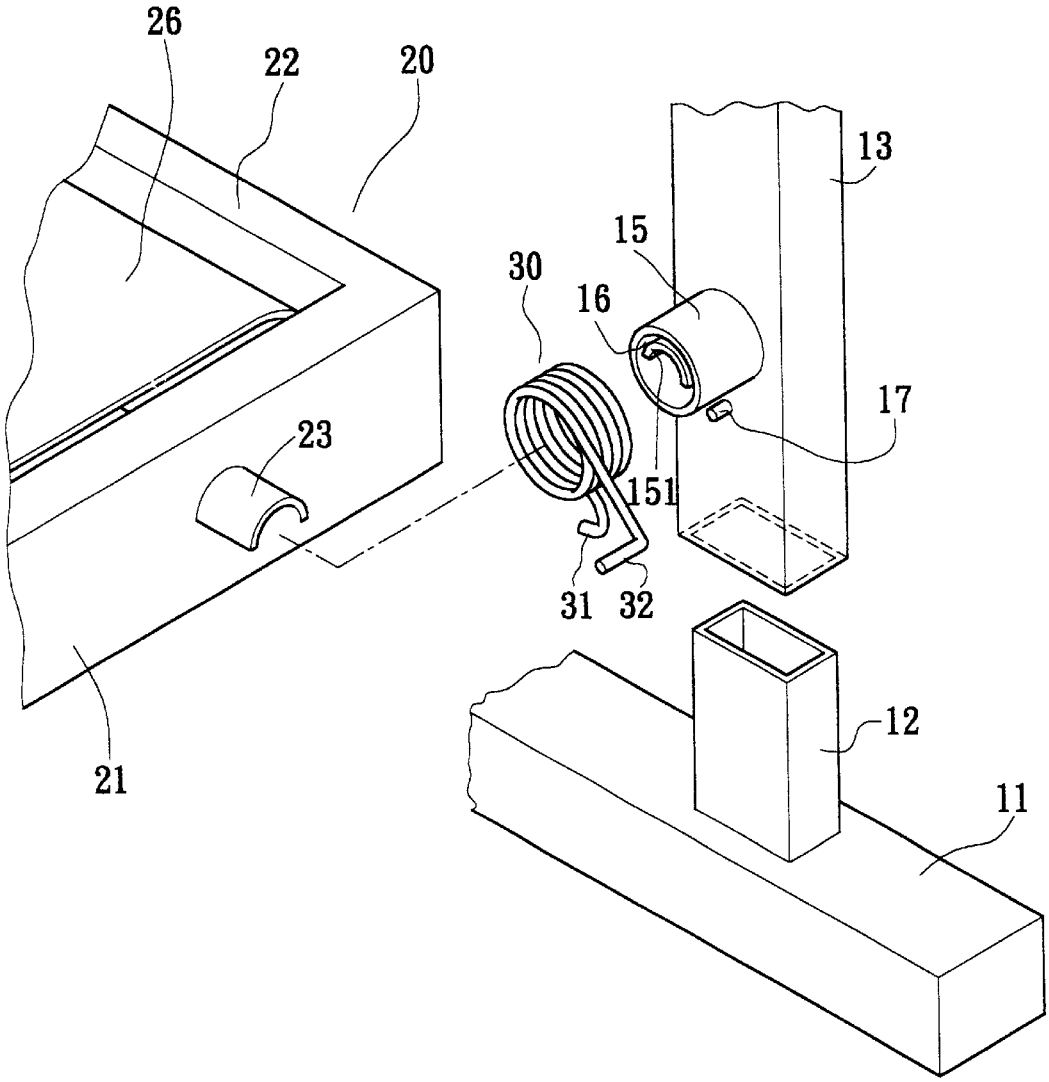
FIG. 2 is a perspective exploded view of the present invention.
Figure 3:
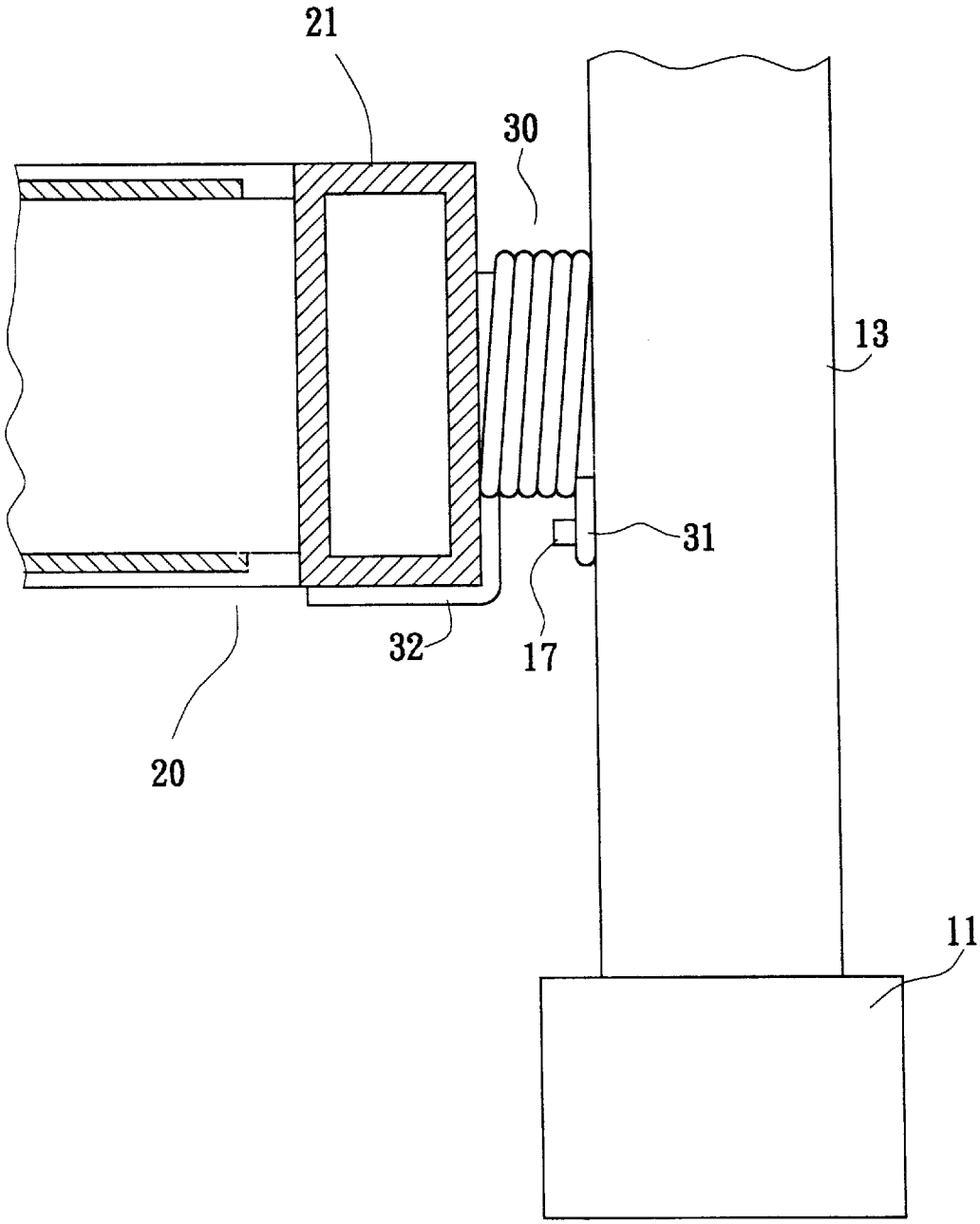
FIG. 3 is a sectional assembled view of the present invention.
Figure 4:
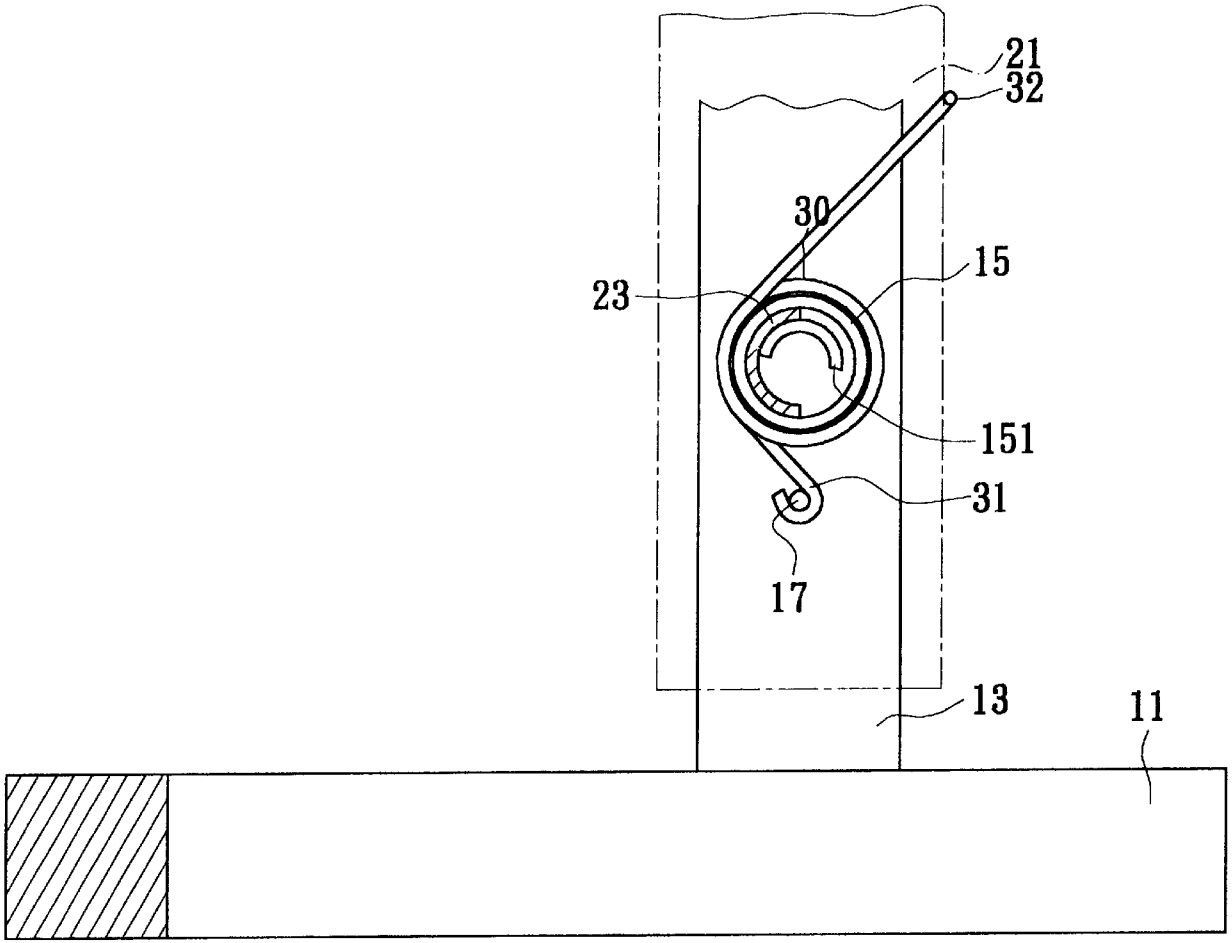
FIG. 4 is a side view showing the movable frame body of the present invention in an upwardly folded position.

Referring to FIGS. 1 to 5, one embodiment of the present invention includes a support stand 10 having a rectangularly contoured base seat 11 at its bottom, each of the left and right sides of the base seat 11 having an upwardly extending connecting bar 12. The support stand 10 further includes an upwardly extending support bar 13 telescopically coupled to each connecting bar 12, a top end of the support bar 13 being connected with each side of rail 14. Near their bottom ends, the inner sides of the support bars 13 are formed with inwardly extending circular tubes 15 within each of which an arch board 151 is disposed. Each circular tube 15 and its arch board 151 define therebetween an arch rail 16. An engaging pin 17 is also formed to project from the inner side of each support bar 13 at a point beneath the circular tube 15.

A movable frame body 20 is disposed between the two support bars 13 of the support stand 10. The frame body 20 is substantially rectangular in configuration and includes two longitudinally extending long bars 21 and two transversely extending short bars 22. The outer sides of the long bars 21 are respectively formed with two arch projecting boards 23. Each projecting board 23 extends into the arch rail 16 defined by one circular tube 15 and its arch board 151.

Two rollers 24 are pivotally disposed to extend between inner front and rear portions of the bars of the frame body 20, with the front roller 24 being driven by motor (not shown). an endless running belt 26 is retained about the rollers 24, and a running board 27 is disposed within the running belt 26.

Two torque springs 30 are respectively fitted on the circular tubes 15 of the support bars 13. The two torque springs 30 are situated to be coiled in different directions. One end of each torque spring 30 forms a hook section 31 for hooking the engaging pins 17 under the circular tube 15. The other end (opposite end) of the torque spring 30 forms a backing section 32 transversely extending from coiled portions of the spring 30 to engage the bottom of a long bar 21 of the frame body 20.

It should be noted that the torque springs 30 are made of steel material by coiling so as to provide a resilient restoring torque when deflected. Prior to assembling the frame body 20, each torque spring 30 is positioned such that in the undeflected state, its backing section 32 extends transversely at its uppermost rear side. After the frame body 20 is assembled (with the frame body 20 pivotally folded upward relative to the support stand 10), the torque spring 30 is slightly deflected by the long bar 21 (about one sixth of a circular coil turn). Consequently, the torque spring 30 is prestressed to hold the frame body 20 back in such position. Therefore, the gravitational force urging the frame body 30 to unfold downward is offset, and the risk of the frame body's dangerous sudden release is reduced.

Figure 5:
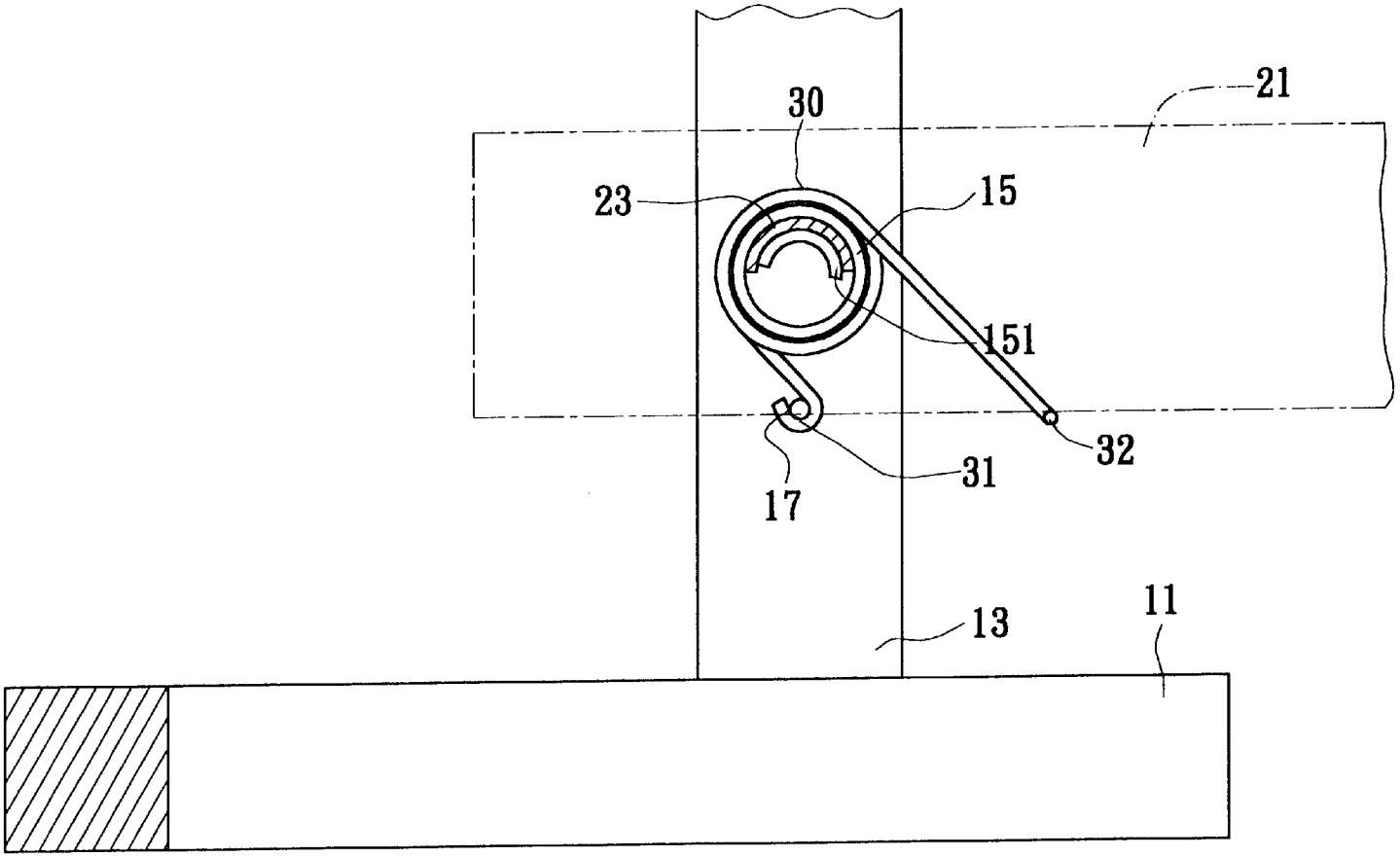
FIG. 5 is a side view showing the movable frame body of the present invention in a downwardly unfolded position; and, FIG. 6 is a perspective view of a conventional treadmill exerciser.
Figure 6:
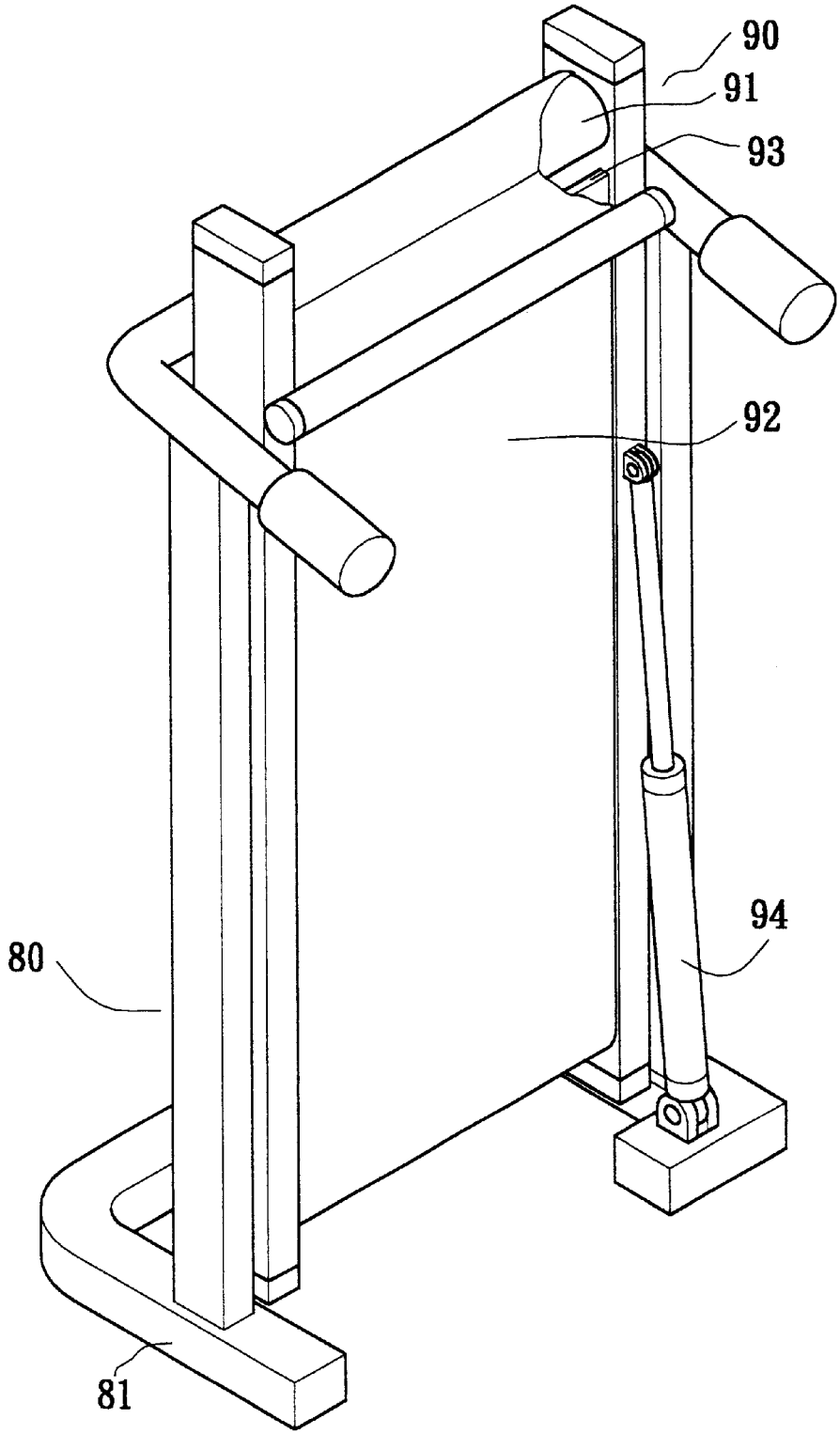
PRIOR ART FIG. 6

In addition, referring to FIG. 5, after use, the frame body 20 can be upwardly folded by raising its terminal rear end to save room. The hook sections 31 of the torque springs 30 hook at two sides the engaging pins 17 protruding from the support bars 13, and the torque springs 30 are coiled in different directions to both provide an upward pushing force. In addition, the backing sections 32 engage the bottoms of the long bars 21 of the frame body 20 to urge the bars upward, offsetting the gravitational force upon the frame body 20. Accordingly, the user can upwardly fold the frame body 20 by raising its rear side without much effort.

Furthermore, the torque springs 30 are made of steel material which is highly tolerant to temperature, humidity and light. The steel material can be optimally heat-treated during manufacture to minimize the possibility of failure and deformation. Even if the torque springs 30 fail and deform, the cost to replace it would remain relatively low.

In addition, the arch rail 16 defined between the circular tube 15 and arch board 151 of the support stand 10 serves as a sliding channel for the projecting board 23 which guides the folding of the frame body 20. Such sliding channel distributes the resulting frictional force, prolonging the useful life of the treadmill exerciser.

In conclusion, the present invention enhances the strength-saving and security features otherwise realized by conventional treadmill exercisers using pneumatic cylinders. The torque springs disclosed herein are highly resistant to damage, yet are low in cost. Also, the circular tube 15 and arch board 151 of the support bar 13 cooperate with the projecting board 23 of the frame body to minimize the effects of friction during folding and unfolding, thereby prolonging the useful life of the treadmill exerciser.

The above embodiments are only used to illustrate the present invention, and are not intended to limit the scope thereof. Many modifications of the above embodiments can be made without departing from the spirit and scope of the present invention as defined by the appended claims.

What is claimed is:

1. A foldable treadmill apparatus comprising:

(a) a support stand including:

(1) a base seat having first and second side portions laterally offset one from the other; and, (2) a pair of support bars extending upward respectively from said first and second side portions of said base seat to support a rail, at least a lower portion of each said support bar defining an inner side surface, each said support bar having a circular tube and an arcuate arch board formed to protrude in substantially concentrically disposed manner from said inner side surface thereof, said circular tube and arch board being radially offset one from the other to define an arch rail therebetween, each said support bar having an engaging pin projecting from said inner side surface thereof to be disposed adjacent one said circular tube;

(b) a movable frame body coupled in pivotally displaceable manner between said support bars of said support stand for reversible displacement between folded and unfolded positions relative to said support stand, said movable frame body including:

(1) a pair of longitudinally extended first bars and a pair of second bars extending transversely therebetween to define a substantially rectangular configuration, each said first bar having an outer side surface and an arcuately extended arch projecting board projecting transversely therefrom to slidably engage said arch slide rail of one said support bar;

(2) a pair of rollers extending in pivotally displaceable manner transversely between said first bars;

(3) an endless running belt looped about said rollers; and, (4) a running board disposed within the loop defined by said running belt; and, (c) at least first and second torque springs respectively coupled to said circular tubes of said support stand support bars and said movable frame body for resiliently biasing said movable frame body to said folded position, said first and second torque springs each having a hook end section retentively engaging said engaging pin of one said support stand and a backing end section transversely extended to engage one of said first bars of said movable frame body for displacement therewith, said first and second torque springs being coiled in opposing angular directions between said hook and backing end sections respectively thereof.

2. The foldable treadmill as recited in claim 1 wherein said base seat of said support stand has formed at each said first and second side portion a connecting bar extending upwardly therefrom, said connecting bars being telescopically coupled respectively to said support bars.

3. The foldable treadmill as recited in claim 1 wherein said at least one of said rollers is displaceable in automatically driven manner.

* * * * *